United States Patent [19]

Gentit et al.

[11] 3,941,708

[45] Mar. 2, 1976

[54] HYDRAULIC FLUID ANTIOXIDANT SYSTEM

[75] Inventors: William F. Gentit, Weston, Conn.; Theodore A. Marolewski, New City, N.Y.

[73] Assignee: Stauffer Chemical Company, Westport, Conn.

[22] Filed: Feb. 11, 1974

[21] Appl. No.: 441,697

[52] U.S. Cl. ..... 252/78; 252/49.8; 252/49.9; 252/77; 252/79 HF; 252/403

[51] Int. Cl.[2] ..... C09K 3/00; C10M 3/40

[58] Field of Search ..... 252/78, 77, 73, 79, 49.8, 252/49.9, 403

[56] References Cited

UNITED STATES PATENTS

| | | | |
|---|---|---|---|
| 2,862,886 | 12/1958 | Davies et al. | 252/78 |
| 2,930,758 | 3/1960 | Tierney et al. | 252/49.9 X |
| 2,982,734 | 5/1961 | Sprague et al. | 252/78 |
| 3,019,191 | 1/1962 | Furby et al. | 252/78 |
| 3,048,545 | 8/1962 | Critchley et al. | 252/78 |
| 3,487,020 | 12/1969 | Peeler | 252/78 |
| 3,574,117 | 4/1971 | Hotten | 252/75 |
| 3,637,507 | 1/1972 | Gentit | 252/78 |
| 3,723,320 | 3/1973 | Herber et al. | 252/78 |
| 3,778,376 | 12/1973 | Herber | 252/78 |

*Primary Examiner*—Harris A. Pitlick
*Attorney, Agent, or Firm*—Charles B. Rodman

[57] ABSTRACT

A hydraulic fluid comprising (1) a base stock material, and (2) a cycloalkyl epoxide and a phenyl naphthylamine in a ratio of from about 1:10 to about 10:1 by weight. By incorporating about 0.1 to about 10 percent by weight of the hydraulic fluid of said epoxide and amine in said hydraulic fluid, acid buildup therein is controlled.

26 Claims, No Drawings

HYDRAULIC FLUID ANTIOXIDANT SYSTEM

Background of the Invention

A number of fluids are known which are intended for use to transmit power in various hydraulic systems including some fluids intended for use in the hydraulic systems of aircraft. The hydraulic power systems of aircraft and certain industrial systems for operating various mechanisms impose stringent requirements on the hydraulic fluid used. Not only must the hydraulic fluid meet stringent functional and use requirements, but in addition such fluid should be sufficiently nonflammable to satisfy requirements for fire resistance. In certain instances, the viscosity characteristics of this fluid must be such that it may be used over a wide temperature range; that is, adequate viscosity at high temperatures, low viscosity at low temperatures and a low rate of change of viscosity with temperature. Its pour point should be low. Its volatility should be low at elevated temperatures of use; that is, selective evaporation or volatilization of any important component should not take place at high temperatures of use. It must possess sufficient lubricity and mechanical stability to enable it to be used in hydraulic systems of aircraft which are exceedingly severe on the fluid used. It should be chemically stable to resist such chemical reactions as oxidation, thermal degradation, etc., so that it will remain stable under conditions of use against loss of desired characteristics, due to high and sudden changes of pressure, temperature, high tensile stresses, and contact with various metals which may be, for example, aluminum, bronze, certain steels, cadmium, magnesium, and the like. It should also not deteriorate or swell the gaskets and packing of the industrial or aircraft hydraulic system. It must not adversely affect the materials of which the system is constructed, and in the event of a leak, should not adversely affect the various parts of the hydraulic system with which it may accidentally come in contact.

In the practice of the present invention functional fluids, to which the epoxide-phenyl naphthylamine compositions of the present invention can be added, are referred to as base stocks. They include, but are not limited to, esters and amides of an acid of phosphorus, mineral oil and synthetic hydrocarbon oil base stocks, monoesters, dicarboxylic acid esters and esters of polyhydric compounds.

Various hydraulic fluid mixtures have been suggested. Phosphate esters to which suitable pour point depressants, viscosity index improvers, rust inhibitors, corrosion inhibitors, etc., have been added, are among the best so far proposed and these have been used somewhat extensively as aircraft hydraulic fluids.

These fluids can, however, exhibit undesirable acid buildup during use. In the event that this acid buildup becomes too excessive, the base stock materials will break down and will lose their physical properties of viscosity and the like. The acid can also attack the metal parts within the hydraulic system that are exposed to the fluids. In order to combat this acid attack, corrosion inhibitors are added to the functional fluid compositions.

One such corrosion inhibitor is described and claimed in U.S. Pat. No. 2,636,861, which includes a combination of specific epoxy compositions with a sulfur containing organic compound. The function of these corrosion inhibitors is to coat the exposed metal with a thin film in such a manner so as to not allow the acid within the fluid to attack the metals. This approach to protecting the exposed metal parts has not been notably successful since the high acid buildup in fact causes corrosion of the metal in addition to breaking down the chemical composition of the functional fluid material so as to require frequent drainage of the system and replacement with new functional fluid compositions.

U.S. Pat. No. 3,637,507 utilizes an epoxide composition to obtain improved acid stability. U.S. Pat. No. 3,019,191 in disclosing the use of diaryl amines as oxidation inhibitors, illustrated by phenyl-α-naphthylamine, finds that substantial amounts of sludge result under oxidative conditions, impeding the flow of the hydraulic fluid and may even result in stoppage.

BRIEF DESCRIPTION OF THE INVENTION

It has been discovered that improved acid stability is provided to a functional fluid material when there is present in the fluid a combination of a certain epoxide and a phenyl naphthyl amine. The addition or incorporation of said epoxide and amine, as hereinafter disclosed, unexpectedly produces synergistic results in terms of improved acid stability and viscosity stability of the functional fluid, without manifesting any deleterious characteristics such as sludge buildup, metal corrosion, and the like.

DETAILED DESCRIPTION

The particular epoxides employed are the epoxycycloalkyl compounds as emplified by the following structure:

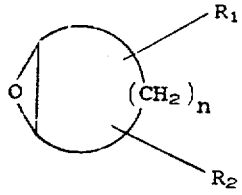

n= 3 to 8 wherein $R_1$ is $-(CH_2)_{0-3}C(O)OR$, $-OR$, $-CH_2OR$ or

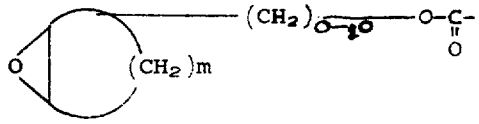

R is an alkyl radical having from 1 to about 12 carbon atoms, $R_2$ is $R_1$, hydrogen, or an alkyl radical having from 1 to about 9 carbon atoms and $n$, $m$=3 to 8.

Preferred epoxide compounds are the 3,4-epoxy cycloalkyl carboxylates. Representative of this class is 3,4-epoxy cyclohexyl methyl, 3,4-epoxy cyclohexane carboxylate which is, particularly preferred and has the following formula:

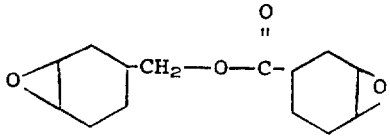

The phenyl naphthylamines employed may be illustrated by the following formula:

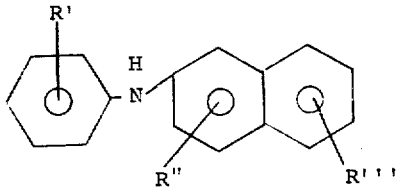

wherein R', R'' and R''' can be the same or different and are members of the group consisting of hydrogen, alkyl, aryl, alkaryl and aralkyl of from 1 to 16 carbon atoms.

Particularly preferred members of this group are phenyl-α-naphthylamine, octylated phenyl-α-naphthylamine (phenyl-α-naphthylamine alkylated with diisobutylene in a 1:1 to 3:1 molar ratio), dioctylphenyl-α-naphthylamine, trioctylphenyl-α-naphthylamine, and the like.

The concentration of cycloalkyl epoxide and phenyl naphthylamine in the functional fluid is adjusted in terms of the particular system and the functional fluid compositions of this invention which contain amounts of cycloalkyl epoxide and phenyl naphthylamine sufficient to inhibit acid buildup. Thus, it has been found that the concentration of cycloalkyl epoxide and phenyl naphthylamine required to inhibit and control acid buildup of a base stock varies according to the base stock or blends of base stocks. Since the cycloalkyl epoxide and phenyl naphthylamine are incorporated in the fluid at levels sufficient to inhibit acid buildup and whereas fluid properties can be altered by the incorporation of any foreign element, it has generally been found that preferred total additive level of cycloalkyl epoxide and phenyl naphthylamine is from about 0.10 percent to about 5.0 percent by weight of the total fluid, although 10.0 weight percent additive concentration is effective and contemplated within the scope of this invention. The ratio of epoxy to secondary diaryl amine can range from about 1:10 to about 10:1 by weight, most preferably about 1:1 by weight.

Thus, included in the present invention are compositions comprising a functional fluid and a cycloalkyl epoxide and phenyl naphthylamine in concentrations sufficient to control and inhibit acid buildup. The functional fluid composition of this invention can be compounded in any manner known to those skilled in the art for incorporation of an additive into a base stock, as for example, by adding the cycloalkyl epoxide and phenyl naphylamine in any order, or together to the base stock with stirring until a homogeneous fluid composition is obtained.

In practice of the present invention, functional fluid compositions that are suitable for use as base stock materials can be esters and amides of an acid of phosphorus which can be represented by the structure:

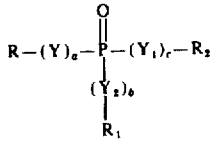

wherein Y is selected from the group consisting of oxygen, sulfur, and

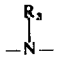

$Y_1$ is selected from the group consisting of oxygen, sulfur and

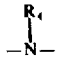

and $Y_2$ is selected from the group consisting of oxygen, sulfur and

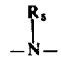

R, $R_1$, $R_2$, $R_3$, $R_4$ and $R_5$ are each selected from the group consisting of alkyl, aryl, substituted aryl and substituted alkyl containing 1–30 carbon atoms, wherein R, $R_1$, $R_2$, $R_3$, $R_4$ and $R_5$ each can be identical or different with respect to any other radical and *a*, *b* and *c* are whole numbers having a value of 0 to 1 and the sum of *a+b+c* is from 1 to 3.

Typical examples of alkyl radicals are as follows: methyl, ethyl, normal propyl, isopropyl, normal butyl, isobutyl, secondary butyl, tertiary butyl, normal amyl, isoamyl, 2-methylbutyl, 2,2-dimethyl propyl, 1-methyl butyl, diethylmethyl, 1,2-dimethyl propyl, tertiary amyl, normal hexyl, 1-methylamyl, 1-ethyl butyl, 1,2,2-trimethyl propyl, 3,3-dimethyl butyl, 1,1,2-trimethyl propyl, 2-methyl amyl, 1,1-dimethyl butyl, 1-ethyl 2-methyl propyl, 1,3-dimethyl butyl, isohexyl, 3-methylamyl, 1,2-dimethyl butyl, 1-methyl 1-ethyl propyl, 2-ethyl butyl, normal heptyl, 1,1,2,3-tetramethyl propyl, 1,2-dimethyl 1-ethyl propyl, 1,1,2-trimethyl butyl, 1-isopropyl 2-methyl propyl, 1-methyl 2-ethyl butyl, 1,1-diethyl propyl, 2-methyl hexyl, 1,1-dimethyl amyl, 1-isopropyl butyl, 1-ethyl 3-methyl butyl, 1,4-dimethyl amyl, isoheptyl, 1-methyl 1-ethyl butyl, 1-ethyl 2-methyl butyl, 1-methyl hexyl, 1-propyl butyl, normal octyl, 1-methyl heptyl, 1,1-diethyl 2-methyl propyl, 1,1,3,3-tetramethyl butyl, 1,1-diethyl butyl, 1,1-dimethyl hexyl, 1-methyl 1-ethyl amyl, 1-methyl 1-propyl butyl, 2-ethyl hexyl, 6-methyl heptyl (iso-octyl), normal nonyl, 1-methyl octyl, 1-ethyl heptyl, 1,1-dimethyl heptyl, 1-ethyl 1-propyl butyl, 1,1-diethyl 3-methyl butyl, diisobutyl methyl, 3,5,5-trimethyl hexyl, 3,5-dimethyl heptyl, normal decyl, 1-propyl heptyl, 1,1-diethyl hexyl, 1,1-dipropyl butyl, 2-isopropyl 5-methyl hexyl and $C_{11-18}$ alkyl groups.

Typical examples of substituted alkyl radicals are the haloalkyl radicals which can be represented by the structure

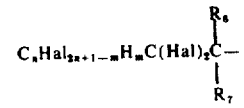

where Hal refers to a halogen, m is less than or equal to $2_n+_1$ and n may have any value from 0 to 18, and $R_6$ and $R_7$ can be hydrogen, halogen or alkyl radicals. The halogenated alkyl radicals can be primary, secondary or tertiary.

Typical examples of aryl and substituted aryl radicals are phenyl, cresyl, xylyl, halogenated phenyl, cresyl and xylyl in which the available hydrogen on the aryl or substituted aryl is partially or totally replaced by a halogen, *o*-, *m*- and p-trifluoromethylphenyl, o-, m- and p-2,2,2-trifluoroethylphenyl, o-, m- and p-3,3,3-trifluoropropylphenyl and o-, m- and p-4,4,4-trifluorobutylphenyl.

Dicarboxylic acid esters which are suitable as base stocks are represented by the structure

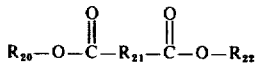

wherein $R_{20}$ and $R_{22}$ are each selected from the group consisting of alkyl, substituted alkyl, aryl and substituted aryl and $R_{21}$ is a divalent radical selected from the group consisting of alkylene and substituted alkylene, and are prepared by esterifying dicarboxylic acids as adipic acid, azelaic acid, suberic acid, sebacic acid, hydroxysuccinic acid, fumaric acid, maleic acid, etc., with alcohols such as butyl alcohol, hexyl alcohol, 2-ethylhexyl alcohol, dodecyl alcohol, 2,2-dimethyl heptanol, 1-methyl cyclohexyl methanol, etc.

Typical examples of alkyl, aryl substituted alkyl and substituted aryl radicals are given above.

Polyesters which are suitable as base stocks are represented by the structure

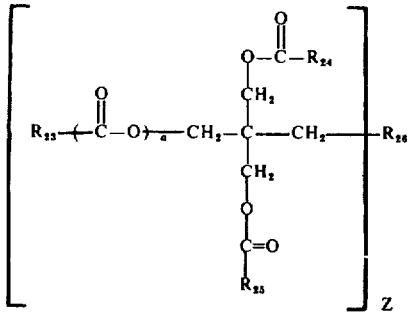

wherein $R_{23}$ is selected from the group consisting of hydrogen and alkyl, $R_{24}$ and $R_{25}$ are each selected from the group consisting of alkyl, substituted alkyl, aryl and substituted aryl, *a* is a whole number having a value of 0 to 1, Z is a whole number having a value of 1 to 2 and when Z is 1 $R_{26}$ is selected from the group consisting of hydrogen, alkyl acyloxy and substituted acyloxy and when Z is 2 $R_{26}$ is oxygen, and are prepared by esterifying such polyalcohols as pentaerythritol, dipentaerythritol, trimethylolpropane, trimetholoethane and neopentyl glycol with such acids as propionic, butyric, isobutyric, n-valeric, caproic, n-heptylic, caprylic, 2-ethylhexanoic, 2,2-dimethylheptanoic and pelargonic. Typical examples of alkyl, substituted alkyl, aryl and substituted aryl radicals are given above.

Other esters which are also suitable as base stocks are the mono esters.

Hydrocarbon oils including mineral oils derived from petroleum sources and synthetic hydrocarbon oils are suitable base stocks. The physical characteristics of functional fluids derived from a mineral oil are selected on the basis of the requirements of the fluid systems and therefore this invention includes as base stocks mineral oils having a wide range of viscosities are volatilities such as naphthenic base, paraffinic base and mixed base mineral oils.

The synthetic hydrocarbon oils include but are not limited to those oils derived from oligomerization of olefins such as polybutenes and oils derived from high alpha olefins of from 8 to 20 carbon atoms by acid catalyzed dimerization and by oligomerization using trialuminum alkyls as catalysts.

It is also contemplated within the scope of this invention that mixtures of two or more of the aforedescribed base stocks can be utilized as base stocks.

The fluid compositions of this invention when utilized as a functional fluid can also contain dyes, pour point depressants, antifoam agents, viscosity index improvers such as polyalkyl acrylates, polyalkyl methacrylates, polycyclic polymers, polyurethanes, polyalkylene oxides and polyesters, lubricity agents, water and the like.

It is also contemplated that the base stocks as aforementioned can be utilized singly or as a fluid composition containing two or more base stocks in varying proportions. The base stocks can also contain other fluids which include, in addition to the functional fluids, desired fluids derived from coal products, synthetics, and synthetic oils, e.g., alkylene polymers (such as polymers of propylene, butylene, etc., and mixtures thereof), alkylene oxide type polymers (e.g., propylene oxide polymers), and derivatives, including alkylene oxide polymers prepared by polymerizing the alkylene oxide in the presence of water or alcohol, e.g., ethyl alcohol, alkyl benzenes, (e.g., monoalkyl benzene such as dodecyl benzene, tetradecyl benzene, etc.) and dialkyl benzene (e.g., n-nonyl 2-ethyl hexyl benzene); and polyphenols, (e.g., biphenyls and terphenyls), In the preferred form of the present invention, the cycloalkyl epoxide and phenyl naphthylamine will be combined with a phosphate functional fluid base stock. The base stock will consist primarily of trialkylphosphates being present in amounts from 50 to 95% by weight and preferably from 60 to 90% by weight. The trialkylphosphates which give optimum results are those wherein each of the alkyl groups contain from 1 to 20 carbon atoms, preferably from 3 to 12 carbon atoms and more preferably, from 4 to 9 carbon atoms. The alkyl groups are preferably of straight chain configuraton. A single trialkyl phosphate may contain the alkyl group in all three positions or may possess a mixture of different alkyl groups. Mixtures of various trialkyl phosphates can be used. Suitable species of trialkyl phosphates which may be employed as the base stock composition include tripropyl phosphates, tributyl phosphates, trihexyl phosphates, trioctyl phosphates, dipropyl octyl phosphates, dibutyl octyl phosphates, dipropyl hexyl phosphate, dihexyl octyl phosphate, dihexyl propyl phosphate, and propyl butyl octyl phosphate.

The trialkyl phosphates can be combined with triaryl phosphates. Preferred triaryl phosphates are cresyl diphenyl phosphate, tricresyl phosphate, trixylenyl phosphate, tertiary butyl phenyl phenyl phosphates, ethyl phenyl dicresyl phosphate or isopropylphenyl diphenyl phosphate, phenyl-bis(4-alpha-methylbenzyl-phenyl) phosphate. In one preferred embodiment, a base stock containing primarily trixylenyl phosphate is employed. The triaryl phosphates function as a thickener for the trialkyl phosphates. Thus, the amount of triaryl phosphate can range between about 0 to about 35% by weight. The preferred range of the triaryl phosphates will be from about 5 to about 30% by weight of the composition.

Conventional polymeric thickeners or viscosity index (VI) improvers may be blended with the mixture of trialkyl and triaryl phosphate material to achieve the desired viscosity. Typical thickeners used may be polyacrylates, polymethacrylates, polyethylene oxides, polypropylene oxides, polyesters and the like.

Preferably, a polyester based upon an azelaic acid and a diol in the range of .3 to 20% by weight is used as the viscosity index improver.

Corrosion inhibitors such as benzotriazole, quinizarin or the like in an amount ranging between 0.001 and 0.5% by weight can be added to the mixture and thoroughly blended therewith. A dye in a concentration range between 5 to 20 parts per million can be added to the composition and blended therewith in a conventional manner. Effective amounts of a silicone antifoaming agent can also be incorporated into the composition and are usually most effective in an amount ranging between 5 and 50 parts per million. The functional fluids of this invention can contain up to about 1 percent by weight of water. It is preferred, however, to maintain water levels below 0.6 weight percent, and most preferably below 0.3 weight percent.

It has been found and practiced that when the cycloalkyl epoxide and phenyl naphthylamine of the present invention are blended in the proper proportions with the above preferred functional fluid composition, the properties thereof are superior to known commercial fluids.

The invention can be better appreciated by the following nonlimiting example. All parts and percentages are by weight, unless otherwise noted.

EXAMPLE

Base stock material samples were prepared, consisting of approximately 68% tributyl phosphate, 19% mixed aryl phosphates of approximately 150 Saybolt Universal Seconds (SUS), 12% of a polybutyl methacrylate viscosity index (VI) improver, 0.5% water, .02% benzotriazole metal deactivator, and an alkyl succinic acid rust inhibitor to which was added 1% 3,4-epoxycyclohexylmethyl-3,4-epoxycyclohexane carboxylate and 1% by weight of the following antioxidants:

| Antioxidant | Total Acid Number (Mg KOH/g) After Test |
|---|---|
| None | 200 |
| Ethyl 702 (a hindered bisphenol) | 73 |
| Pentaerythritol Phosphite Heptanoate | 83 |
| Octylated Phenyl-alpha-naphthyl amine | 10 |
| N-ethyl-dioctyl phenothiazine | 59 |
| Vanlube 81 (a substituted diphenyl amine) | 95 |

-continued

| Antioxidant | Total Acid Number (Mg KOH/g) After Test |
|---|---|
| Phenyl-alpha-naphthylamine | 0.3 |

These tests demonstrate that phenyl-alpha-naphthylamine stabilizes the formulation to the greatest extent in the presence of the cycloalkyl epoxide mentioned above.

In a series of similar oxidation tests performed on a blend consisting of approximately 79 weight percent of tributyl phosphate, 10 weight percent of mixed cresyl and xylenyl phosphates, 9 weight percent of a polyester thickener, Plastolein 9789, sold by Emery Industries, 1 weight percent of phenyl alphanaphthyl-amine, and 0.02 weight percent of benzotriazole, and about 0.25 weight percent water, the following results were obtained with various epoxide acid acceptors at a 1.0 weight percent concentration:

| Acid Acceptor | Total Acid Number (Mg KOH/g) After Test |
|---|---|
| Proctor and Gamble Epoxide 8 | 134 |
| Shell Cardura E (glycidyl ester of decanoic acid) | 194 |
| Phenyl glycidyl ether | 155 |
| 3,4-epoxycyclohexylmethyl-3,4-epoxycyclohexane carboxylate | 0.3 |
| None | 200 |

These results in conjunction with the results in the beginning of this example demonstrate that phenyl alpha-naphthyl amine and 3,4-epoxycyclohexylmethyl-3,4-epoxycyclohexane carboxylate form a unique synergistic additive combination for the stabilization of phosphate esters.

What is claimed is:

1. A functional fluid composition comprising a mixture of a base stock material consisting essentially of an ester or esters of an acid of phosphorus, and from about 0.1 to about 10%, by weight of the total fluid, of an additive combination comprising an epoxycycloalkyl carboxylate and a phenyl naphthylamine, in a ratio of from about 1:10 to about 10:1 by weight.

2. A functional fluid in accordance with claim 1, wherein said ester of an acid of phosphorus comprises a trialkyl phosphate.

3. A functional fluid in accordance with claim 1 wherein said ester of an acid of phosphorus comprises a triaryl phosphate.

4. A functional fluid in accordance with claim 1 wherein said ester of an acid of phosphorus comprises a mixture of trialkyl phosphates and triaryl phosphates.

5. A functional fluid in accordance with claim 4, wherein said trialkyl phosphates are present in an amount ranging between 50 and 95% by weight and said triaryl phosphates are present in an amount up to about 35% by weight.

6. A functional fluid in accordance with claim 1 wherein said phenyl naphthyl amine is phenyl-α-naphthylamine.

7. A functional fluid in accordance with claim 1 wherein said epoxycycloalkyl carboxylate is 3,4,-epoxycyclohexylmethyl 3,4-epoxycyclo-hexane carboxylate.

8. A functional fluid in accordance with claim 1 together with a viscosity index improver or thickener.

9. A functional fluid in accordance with claim 8, together with a dye and antifoaming agent mixed therewith.

10. A functional fluid in accordance with claim 9, together with a corrosion inhibitor.

11. A functional fluid composition in accordance with claim 10 wherein said corrosion inhibitor is benzotriazole.

12. An aircraft hydraulic fluid comprising a base stock material consisting essentially of an ester or esters of an acid of phosphorus, and from about 0.1 to about 10% by weight of the total fluid of an additive combination comprising an epoxycycloalkyl carboxylate and a phenyl naphthylamine in a ratio from about 1:10 to about 10:1 by weight.

13. The composition of claim 12 wherein said phenyl naphthylamine comprises phenyl-α-naphthyl amine.

14. The composition of claim 12 also containing a viscosity index improver.

15. The composition of claim 12 which also contains a rust inhibitor.

16. The composition of claim 12 wherein said carboxylate is 3,4-epoxycyclohexylmethyl 3,4-epoxycyclohexane carboxylate.

17. The composition of claim 12 also containing a corrosion inhibitor selected from the group consisting of benzotriazole and quinizarin.

18. The composition of claim 17 wherein said corrosion inhibitor is benzotriazole.

19. The composition of claim 12 in which said ester of an acid of phosphorus is a trialkyl phosphate.

20. The composition of claim 12 wherein said ester of an acid of phosphorus is a mixture of trialkyl phosphates and triaryl phosphates.

21. The composition of claim 20 in which said trialkyl phosphates are present in an amount ranging between about 50 and about 95% by weight and the triaryl phosphates are present in an amount up to about 35% by weight.

22. The composition of claim 12 wherein said ester of an acid of phosphorus comprises a mixture of a trialkyl phosphate and an ester selected from the group consisting of alkyl diaryl phosphate and dialkyl aryl phosphate.

23. The composition of claim 12 wherein said additive is present in an amount of from about 0.1 to about 5 weight percent.

24. A method for controlling acid buildup in an aircraft hydraulic fluid comprising a base stock selected from the group consisting of esters of an acid of phosphorus, which comprises incorporating in said hydraulic fluid from between about 0.1 to about 10% by weight of an additive comprising an epoxycycloalkyl carboxylate and a phenyl naphthylamine in a ratio of from about 1:10 to about 10:1 by weight.

25. The method of claim 24 wherein said phenyl naphthylamine comprises phenyl-α-naphthylamine.

26. The method of claim 25 wherein said carboxylate comprises 3,4-epoxycyclohexylmethyl 3,4-epoxycyclohexane carboxylate.

* * * * *